US005269384A

United States Patent [19]

Cherrington

[11] Patent Number: 5,269,384

[45] Date of Patent: Dec. 14, 1993

[54] METHOD AND APPARATUS FOR CLEANING A BORE HOLE

[75] Inventor: Martin D. Cherrington, Fair Oaks, Calif.

[73] Assignee: Cherrington Corporation, Sacramento, Calif.

[21] Appl. No.: 789,356

[22] Filed: Nov. 8, 1991

[51] Int. Cl.[5] ..... E21B 7/28

[52] U.S. Cl. ..... 175/53; 175/62; 175/102; 175/316; 175/324

[58] Field of Search ..... 166/312, 372, 370, 68, 166/105; 175/53, 62, 324, 323, 100, 102, 316

[56] References Cited

U.S. PATENT DOCUMENTS

| | | | |
|---|---|---|---|
| 1,322,358 | 11/1919 | Sharpnack | 166/68 X |
| 1,604,644 | 10/1926 | Heyser | 166/105 |
| 1,657,611 | 1/1928 | Bell | 175/408 X |
| 2,383,496 | 8/1945 | Nebolsine | 175/324 X |
| 3,413,045 | 11/1968 | Wohlfeld | 175/325.3 |
| 3,536,151 | 10/1970 | Aarup | 175/422 |
| 4,003,440 | 6/1977 | Cherrington | 175/61 |
| 4,091,631 | 5/1978 | Cherrington | 61/72.7 |
| 4,117,895 | 10/1978 | Ward et al. | 175/53 |
| 4,121,673 | 10/1978 | Cherrington | 175/61 |
| 4,134,619 | 1/1979 | Bunnelle | 299/17 |
| 4,176,985 | 12/1979 | Cherrington | 405/184 |
| 4,212,353 | 7/1980 | Hall | 299/17 X |
| 4,221,503 | 9/1980 | Cherrington | 405/184 |
| 4,348,058 | 9/1982 | Coakley et al. | 299/17 |
| 4,453,603 | 6/1984 | Voss et al. | 175/53 |
| 4,540,055 | 9/1985 | Drummond et al. | 175/323 |
| 4,589,504 | 5/1986 | Simpson | 175/267 |
| 4,674,579 | 6/1987 | Geller et al. | 175/45 |
| 4,679,637 | 7/1987 | Cherrington et al. | 175/61 |
| 4,714,118 | 12/1987 | Baker et al. | 175/26 |
| 4,718,728 | 1/1988 | Hodges | 299/17 |
| 4,744,420 | 5/1988 | Patterson et al. | 166/312 |
| 4,915,181 | 4/1990 | Labrosse | 175/267 X |
| 5,033,545 | 7/1991 | Sudol | 166/312 |
| 5,069,285 | 12/1991 | Nuckols | 166/68 X |
| 5,086,842 | 2/1992 | Cholet | 166/312 |
| 5,096,002 | 3/1992 | Cherrington | 175/53 |

FOREIGN PATENT DOCUMENTS

| | | | |
|---|---|---|---|
| 1514943 | 10/1989 | U.S.S.R. | 175/53 |

*Primary Examiner*—Hoang C. Dang
*Attorney, Agent, or Firm*—Vinson & Elkins

[57] ABSTRACT

A hole cleaning device 100 includes a housing having a porous region to communicate cuttings from a bore hole to the interior of the housing. A Venturi-effect pump creates a suction to draw cuttings from the hole into the housing. An outlet pipe coupled to the Venturi pump transports the cuttings out of the housing.

18 Claims, 5 Drawing Sheets

4a
4a
110
102
118
114
114
102
110
122
D
100
106
110
110
110
110
110
108
104
102
104

100
106
116
114
118
122
4b
4b
110
120
108
112
102
104
104
FLUID
FLUID AND CUTTINGS

METHOD AND APPARATUS FOR CLEANING A BORE HOLE

RELATED APPLICATIONS

This patent application is related to U.S. patent application Ser. No. 07/790,223, filed Nov. 8, 1991, entitled "Method and Apparatus For Cleaning A Bore Hole Using A Rotary Pump", by Martin Cherrington, incorporated by reference herein.

TECHNICAL FIELD OF THE INVENTION

This invention relates in general to hole drilling, and more particularly to a device for removing cuttings from a hole

BACKGROUND OF THE INVENTION

Underground conduits are widely used for the transmission of fluids, such as in pipelines and the like, as well as for carrying wires and cables for the transmission of electrical power and electrical communication signals. While the installation of such conduits is time-consuming and costly for locations where the earth can be excavated from the surface, the routing of such conduits becomes more difficult where such surface excavation cannot be done due to the presence of surface obstacles through which the excavation cannot easily proceed. Such surface obstacles include highways and railroads, where the installation of a crossing conduit would require the shutdown of traffic during the excavation and installation. Such surface obstacles also include rivers, which present extremely difficult problems for installing a crossing conduit, due to their size and the difficulty of excavation thereunder.

Prior methods for the installation of conduits have included the use of directional drilling for the formation of an inverted underground arcuate path extending between two surface locations and under the surface obstacle, with the conduit installed along the drilled path. A conventional and useful method for installing such underground conduits is disclosed in U.S. Pat. No 4,679,637, issued Jul. 14, 1987, assigned to Cherrington Corporation, and incorporated herein by this reference. This patent discloses a method for forming an enlarged arcuate bore and installing a conduit therein, beginning with the directional drilling of a pilot hole between the surface locations and under a surface obstacle such as a river. Following the drilling of the pilot hole, a reamer is pulled with the pilot drill string from the exit opening toward the entry opening, in order to enlarge the pilot hole to a size which will accept the conduit, or production casing in the case of a pipeline conduit. The conduit may be installed during the reaming operation, by the connection of a swivel behind the reamer and the connection of the conduit to the swivel, so that the conduit is installed as the reaming of the hole is performed. Alternatively, the conduit can be installed in a separate operation, following the reaming of the pilot hole (such reaming referred to as "pre-reaming" of the hole). Additional examples of the reaming operation, both as pre-reaming and in conjunction with the simultaneous installation of the product conduit, are described in U.S. Pat. No. 4,784,230, issued Nov. 15, 1988, assigned to Cherrington Corporation and incorporated by this reference.

While the above-described methods are generally successful in the installation of such conduit, certain problems have been observed, especially where certain types of sub-surface formations are encountered. Referring now to FIGS. 1 and 2, examples of such problems in the installation of conduit in an underground arcuate path will now be described.

FIG. 1 illustrates the reaming operation described above, in conjunction with the installation of production conduit as the reamer is pulled back. In the example of FIG. 1, entry opening 0 is at surface S on one side of river R; exit opening E is on the other side of river R from entry opening 0. At the point in the installation process illustrated in FIG. 1, a drilling apparatus, including a hydraulic motor 14 mounted on a carriage 16 which is in place on an inclined ramp 12, has drilled the pilot bore hole B from entry 0 to exit E, using drill string 10, and the reaming and installation is in progress. Motor 14 is now pulling reamer 48, to which production conduit 46 is mounted, back from exit E toward entry 0. Reamer 48 is larger in diameter than the diameter of production conduit 46. Upon completion of the reaming operation of FIG. 1, if successful, production conduit 46 will be in place under river R, and extending between exit E and entry 0.

Referring now to FIG. 2, a close-up view of the location of reamer 48 and production conduit 46 in FIG. 1 is now illustrated. Leading drill string section 10C is attached by way of tool joint 52 to reamer 48, reamer 48 having cutting teeth at its face. Swivel 50 connects production conduit 46 to reamer 48, by way of extension 62 connected to a sleeve 66 on conduit 46. As is evident from FIGS. 1 and 2, bore hole B is enlarged to enlarged opening D by operation of reamer 48. Conventional sizes of conduit 46 are on the order of 20 to 48 inches in outside diameter, with the size of reamer 48 greater in diameter than conduit 46. Due to reamer 48 being larger than conduit 46, an annulus 68 surrounds conduit 46 as it is pulled into the hole D. Provision of the annulus 68 allows for reduced friction as the conduit 46 is placed therein.

As noted above, prior techniques have also included a pre-reaming step, wherein a reamer, such as reamer 48, is pulled back from exit E to entry 0 without also pulling production conduit 46 into the reamed hole. In such a pre-reaming step, a following pipe generally trails reamer 48 in such the same manner as conduit 46 trails reamer 48 in FIGS. 1 and 2, to provide a string for later installation of conduit 46. Such a trailing pipe will be of a much smaller size than conduit 46 of FIGS. 1 and 2, for example on the order of five to ten inches in diameter.

It has been observed in the field that both the pre-reaming and reaming with installation operations are subject to conduit or pipe sticking problems, especially as the size of the production conduit increases in diameter, and as the length of the path from entry 0 to exit E increases. Such sticking is believed to be due, in large degree, to the inability to remove cuttings resulting from the reaming operation. Due to the large volume of earth which is cut by way of the reaming operation, and the generally low fluid flow velocity of drilling or lubricating mud or fluid into the reaming location, the velocity of cuttings circulating from the reaming location is minimal. While the mud or other lubricating fluid flow could be increased in order to increase the velocity of the cuttings from the reaming location, such an increase in the velocity of the fluid could result in such undesired results as hole wall erosion and fracturing through the formation.

Due to the inability to sufficiently remove the cuttings during the reaming operation, it is believed that the cuttings pack together near the location of the reamer. Many of the cuttings from the reaming operation are heavier than the fluid transporting them and, in such large diameter holes as are required for the installation of conduit, these large cuttings will fall out or settle toward the bottom of the hole first, and then build up into a circumferential packed mass, causing a poor rate of reaming. Referring to FIG. 2, where a production conduit 46 is being pulled through with reamer 48, it is believed that such packing will begin at locations P surrounding the leading end of conduit 46, and also along the sides of conduit 46 in annulus 68. As the cuttings pack together, squeezing whatever water or fluid is present therein, the density of the packed mass increases. Upon sufficient packing, it is believed that pressure builds up ahead of locations P, toward the bit of reamer 48, such pressure resulting from the mud or fluid continuing to be pumped into the reaming location with the return flow reduced at locations P around conduit 46 in annulus 68. It is also believed that this buildup of pressure will also force cuttings into bore hole B ahead of reamer 48, and that these cuttings will also begin to pack, most likely at locations P' near the first tool joint 70 ahead of reamer 48.

The buildup of pressure between locations P and P' surrounding reamer 48 causes significant problems in the reaming operation. Such effects have been observed in the field during reaming operations, when the reamer cannot be rotated, pulled or pushed at a particular location in the operation. It should be noted that the sticking of the reamer occurs both for the pre-reaming operation described hereinabove and for the combined reaming and pulling operation. It should further be noted that the pressure buildup described hereinabove is believed to be worse in high pressure formations such as clay.

Another undesired effect resulting from the buildup of pressure when the reamer cuttings are insufficiently removed is similar in nature to differential sticking in the downhole drilling field. As is well known in the downhole drilling art, differential sticking of the drill string occurs when the pressure of the drilling mud surrounding the drill string is greater than the pressure exerted by the surrounding formation. In the event that the caking of drilling mud and the structure of the well bore is not strong enough to maintain its shape when presented with such a differential pressure, the pressure of the drilling mud can force the drill string into the formation, holding it there with sufficient pressure that it cannot be released from the surface.

It is now believed that similar effects can be present in the field of installation of underground conduit, due to insufficient removal of the reaming cuttings. If the pressure near reamer 48, when packed off as described hereinabove, is sufficiently greater than the pressure exerted by a surrounding formation, the conduit 46 can be driven into the formation, causing sticking of the conduit 46 thereat. It should be noted that the installation of underground conduit is particularly susceptible to such sticking, since much of the formations underlying rivers are sedimentary or alluvial formations, with relatively thin layers of differing strength. Accordingly, the drilling and reaming operations in river crossing installations are exposed to many differing formations along the length of the path, with the likelihood of encountering a weak (in pressure) formation being relatively large. Accordingly, such pressure buildup due to insufficient reaming cutting removal can cause conduit sticking at particular locations along the underground path.

Furthermore, it should be noted that the insufficient removal of cuttings impacts the reaming operation itself. If cuttings are not sufficiently removed from the reaming location, a number of cuttings will tend to be present in front of reamer 48 of FIG. 2; as a result, reamer 48 will tend to recut its own cuttings, rather than cutting the earth in its path and enlarging the hole. This results in poor penetration rates for the reaming operation. As noted above, as the reaming rate slows, the pressure buildup between the packed locations will accelerate, further degrading the operation and increasing the likelihood of the reamer and conduit sticking.

In addition, the recutting of the cuttings results in a high degree of reamer wear, both at the teeth and also in the parent metal of reamer 48. In rotor reamers, such wear has been observed also at the seals and bearings. This has also been observed for reamers which use carbide-coated rotating cones as the cutting bits, in similar manner as a downhole tri-cone bit; while the carbide wears slowly, the insufficient removal of the cuttings has been evidence in significant wear of the parent metal of the reamer. Furthermore, as the cuttings become smaller due to multiple recutting cycles, the cuttings which are removed with the drilling mud are much more difficult to process by the solids control system.

Other methods for installing conduit in an underground path includes forward thrust techniques, such as described in U.S. Pat. Nos. 4,176,985, 4,221,503 and 4,121,673. Particularly, U.S. Pat. No. 4,176,985 discloses an apparatus which thrusts a casing into a pilot hole, with a bit leading the casing. However, while such forward thrust techniques are useful for unidirectional application such as the introduction of conduits into the ocean, such methods place significant stress on the conduit itself, and also present relatively slow installation rates. The pull-back methods described hereinabove and hereinbelow are preferable from the standpoint of reduced stress on the casing, as well as increased installation rates.

A method and apparatus for removing cuttings is described in U.S. Pat. No. 5,096,002 to Cherrington, filed Jul. 26, 1990, entitled "Method and Apparatus for Enlarging an Underground Path", which is incorporated by reference herein. While the device described in U.S. Pat. No. 5,096,002 is effective in removing the cuttings, it relies on several moving parts, which may decrease its reliability.

Therefore, a need has arisen in the industry for a method and apparatus for removing cuttings from a bore hole with a reduced number of working parts.

SUMMARY OF THE INVENTION

The method and apparatus of the present invention provides for effective removal of cuttings from a bore hole which substantially overcome problems associated with other such devices. The removing apparatus includes a housing having a porous first region for communicating cuttings from the bore hole to the interior of the housing. A jet pump creates a suction to draw cuttings from the bore hole into the housing. An outlet pipe transports the cuttings out of the housing In one aspect of the invention, the jet pump comprises a nozzle and a throat; a fluid is forced through the nozzle into the throat, thereby creating a pressure differential to draw the cuttings through the porous first region.

Since the Venturi pump creates a suction without working parts, the reliability of the apparatus is greatly enhanced.

BRIEF DESCRIPTION OF THE DRAWINGS

For a more complete understanding of the present invention, and the advantages thereof, reference is now made to the following descriptions taken in conjunction with the drawings, in which:

FIG. 3 is a side view of a the preferred embodiment of hole cleaning device of the present invention;

DETAILED DESCRIPTION OF THE INVENTION

Figure 1:
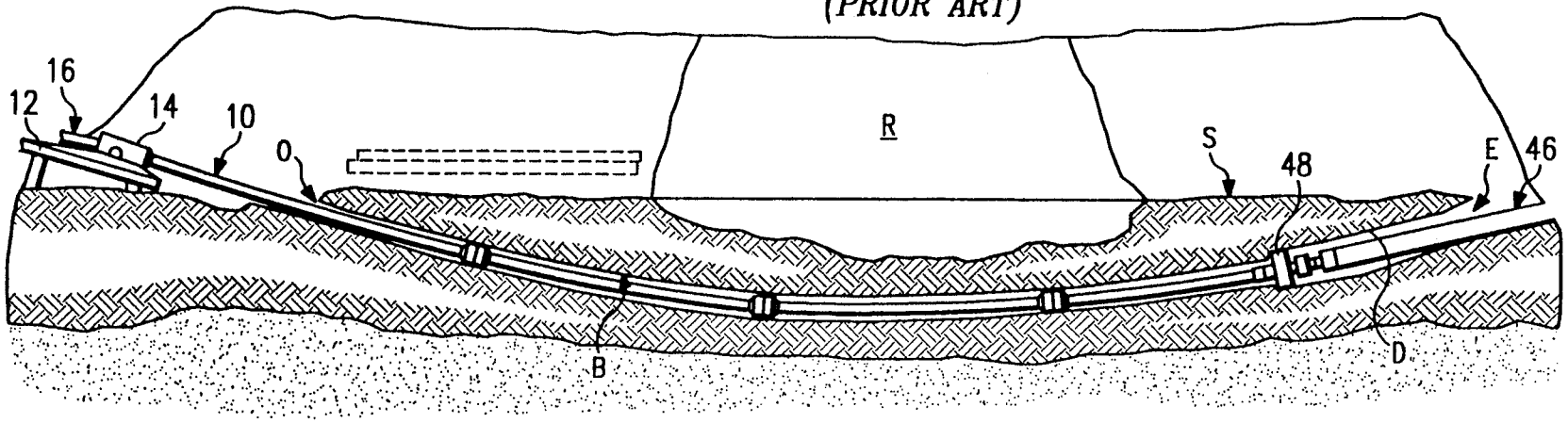
FIG. 1 (PRIOR ART)
FIGS. 1 and 2 are cross-sectional drawings showing an apparatus for reaming and installing a conduit according to the prior art.
Figure 2:
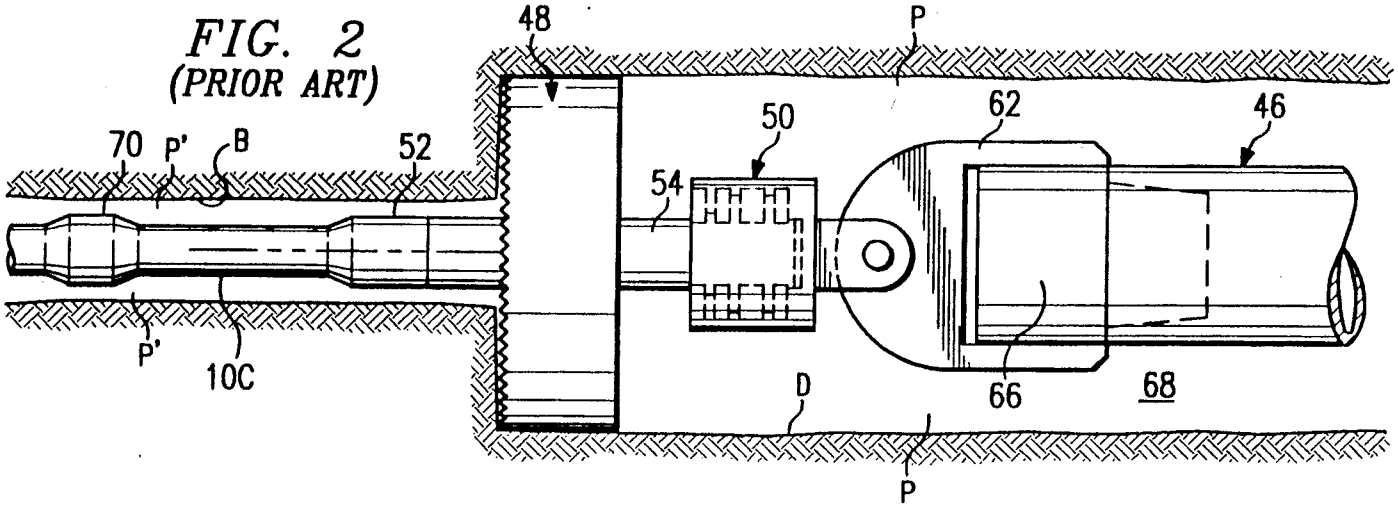
FIG. 2 (PRIOR ART)

The preferred embodiment of the present invention and its advantages are best understood by referring to FIGS. 3–7 of the drawings, like numerals being used for like and corresponding parts of the various drawings.

FIG. 3 illustrates a cutaway view of a preferred embodiment of the hole cleaning device of the present invention, where the hole cleaning device is used to remove cuttings from a hole which has already been drilled to substantially the desired diameter. In FIG. 3, the hole cleaning device 100 is shown in hole D having cuttings 102 remaining on the walls 104 of hole D. The exterior of the hole cleaning device 100 has a tapered front 106 to allow the hole cleaning device 100 to follow the contours of hole D. Housing 108 has openings 110 to allow the cuttings 102 to pass from the hole D to the interior of the hole cleaning device 100.

In operation, the hole cleaning device is rotated within hole D by a drilling motor on the surface, such as motor 14 of FIG. 1. A pressure differential is created, as will be described in greater detail in connection with FIGS. 4 and 5, to draw the cuttings 102 through the openings 110. The cuttings 102 will be transported out of the hole D for processing by a solids control system (not shown).

Figure 4B:
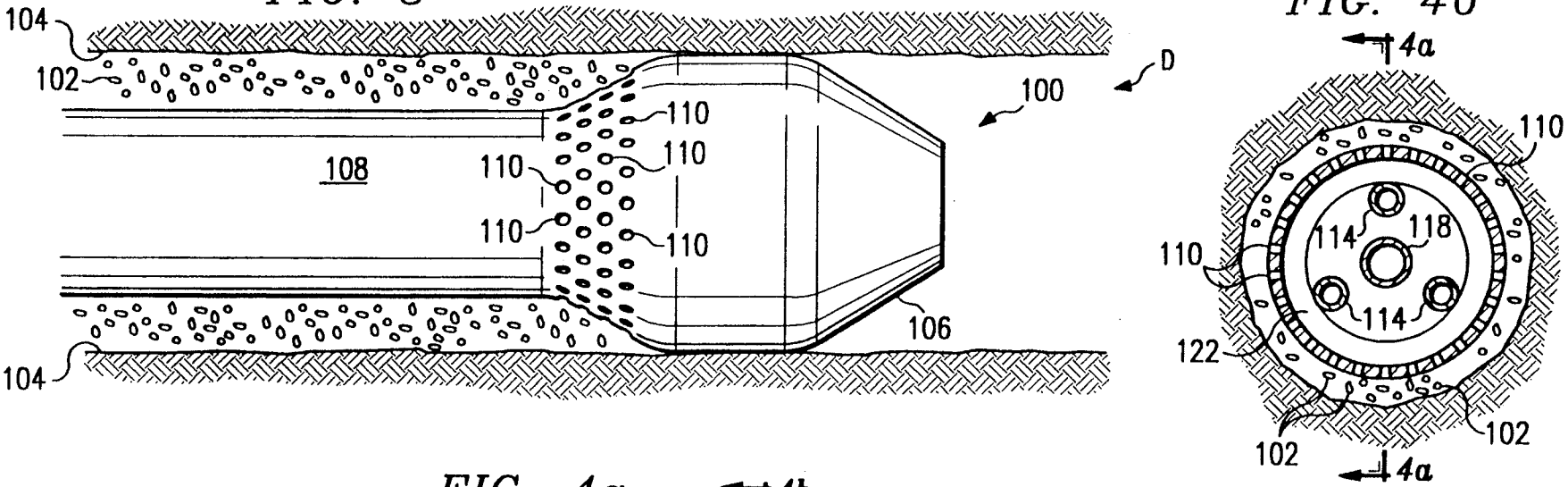
FIGS. 4*a* and 4*b* are cross-sectional side and front views of the hole cleaning device of FIG. 3.
Figure 4A:
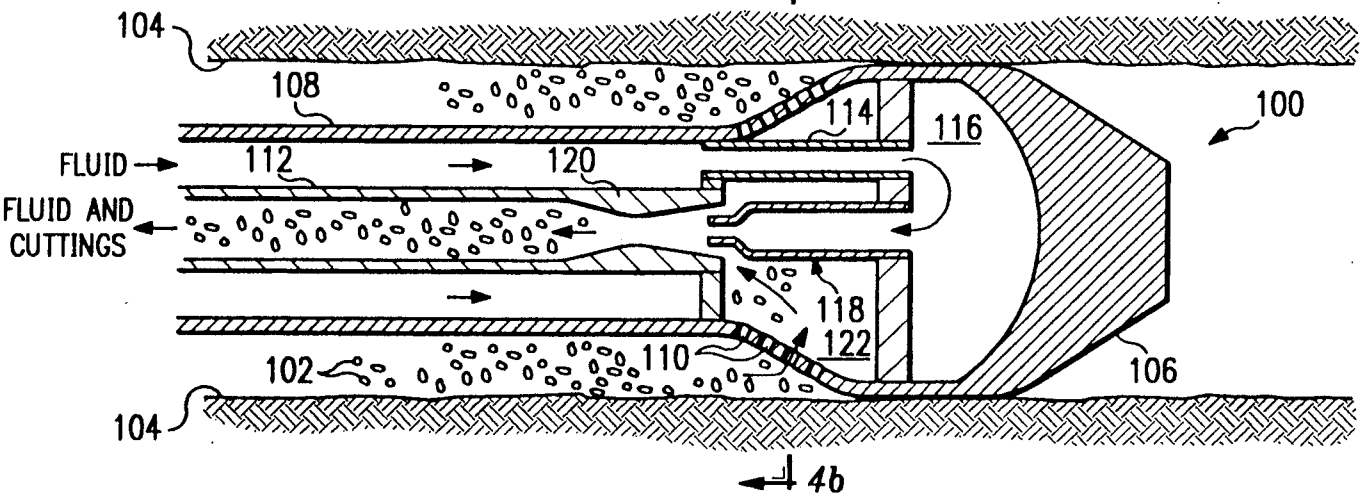

FIGS. 4*a*–*b* illustrate a cross-sectional side view and a cross-sectional front view, respectively, of the hole cleaning device 100 which uses a jet pump to remove cuttings from the hole. A jet pump uses a stream of fluid (or gas) under controlled conditions to create a low-pressure area to which another material (in this case, the cuttings) is drawn and subsequently combined with the fluid. Interior to the housing 108 is an outlet pipe 112. A cleaning substance, typically water or drilling fluid, is forced between the housing 108 and the outlet pipe 112. The fluid is fed through one or more inlet pipes 114 to a chamber 116. From the chamber 116, the fluid is forced through a jet nozzle assembly 118 into a diffuser assembly 120 which is in communication with the outlet pipe 112. The flow of the fluid through the nozzle assembly 118 and the diffuser assembly 120 causes a pressure differential by the Venturi effect. This pressure differential acts as a pump to draw the cuttings 102 through the openings 110 into the suction chamber 122 which is in communication with the throat 120. The cuttings 102 in the chamber 122 are further drawn through the diffuser assembly 120 where they are mixed with the fluid and transported to the surface via outlet pipe 112.

FIG. 4*b* illustrates a cross-sectional front view showing the preferred embodiment of the hole cleaning device 100 of FIG. 3 wherein three inlet pipes 114 are used to transport the fluid from the area between the housing 108 and the outlet pipe 112 to the chamber 116.

In the preferred embodiment, the openings 110 are formed by providing holes through the exterior of the housing 108. During rotation of the housing, the holes will break large cuttings to a size which may be passed into the diffuser assembly 120. Thus, the size of the openings 110 should be determined based on the spacing between the jet nozzle assembly and the diffuser assembly 120. In the illustrated embodiment, a three-quarters inch diameter hole has been found effective. Alternatively, a grate or other structure to size the cuttings could be implemented about the housing 108.

The space between the nozzle assembly 118 and the diffuser assembly 120 is important to the operation of the hole cleaning device 100. An optimum length depends upon a number of factors including the composition of the subsurface through which the hole D is drilled, the speed of the fluid out of the jet nozzle, and the shape of the diffuser assembly 120. The illustrated embodiment shows an adjustable nozzle (illustrated in greater detail in FIG. 5*b*) which allows adjustments to provide the maximum cleaning action. The shape of diffuser assembly 120 also affects the efficiency of the hole cleaning operation.

Figure 5A:
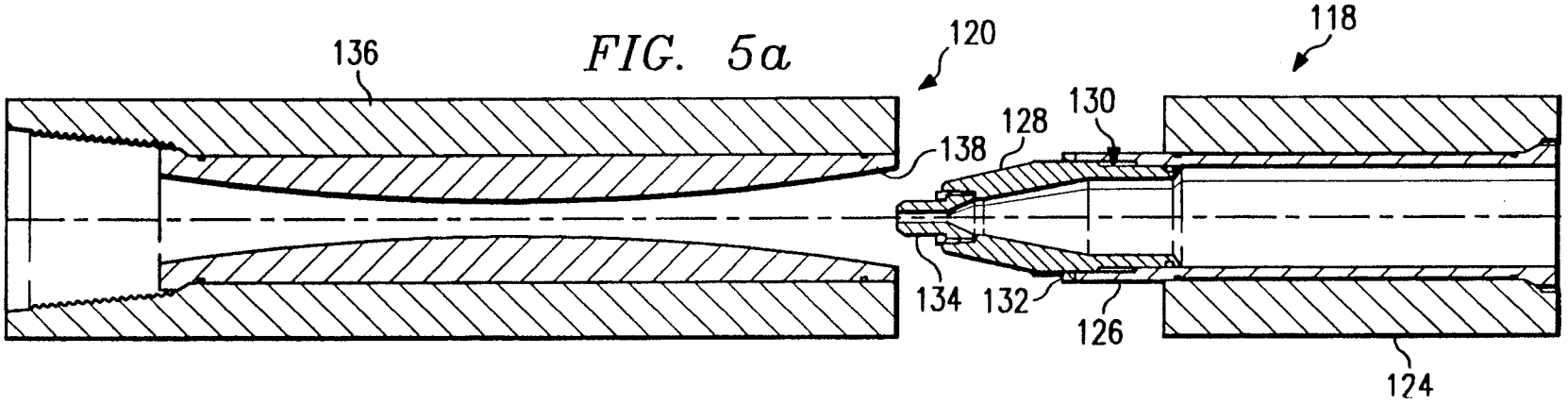
FIGS. 5*a* and 5*b* are detailed cross-sectional views of the nozzle and throat assemblies.

FIG. 5*a* illustrates a detailed cross-sectional diagram of the nozzle assembly 118 and diffuser assembly 120. The jet nozzle assembly 118 includes an outer sleeve 124 into which an inner sleeve 126 is placed. A nozzle housing 128 is threaded into inner sleeve 126. Threads 130 allow the nozzle housing 128 to be extended or retracted into inner sleeve 126. Lock nut 132 holds the nozzle housing in place. Jet nozzle tip 134 is held by nozzle housing 128. The illustrated embodiment is best suited for experimentation to determine an optimum configuration for a particular application. After determining the optimum configuration, a fixed length jet nozzle would normally be used.

The diffuser assembly 120 includes outer sleeve 136 having diffuser 138 connected thereto. Outer sleeve 136 is coupled to outlet tube 112.

Figure 5B:
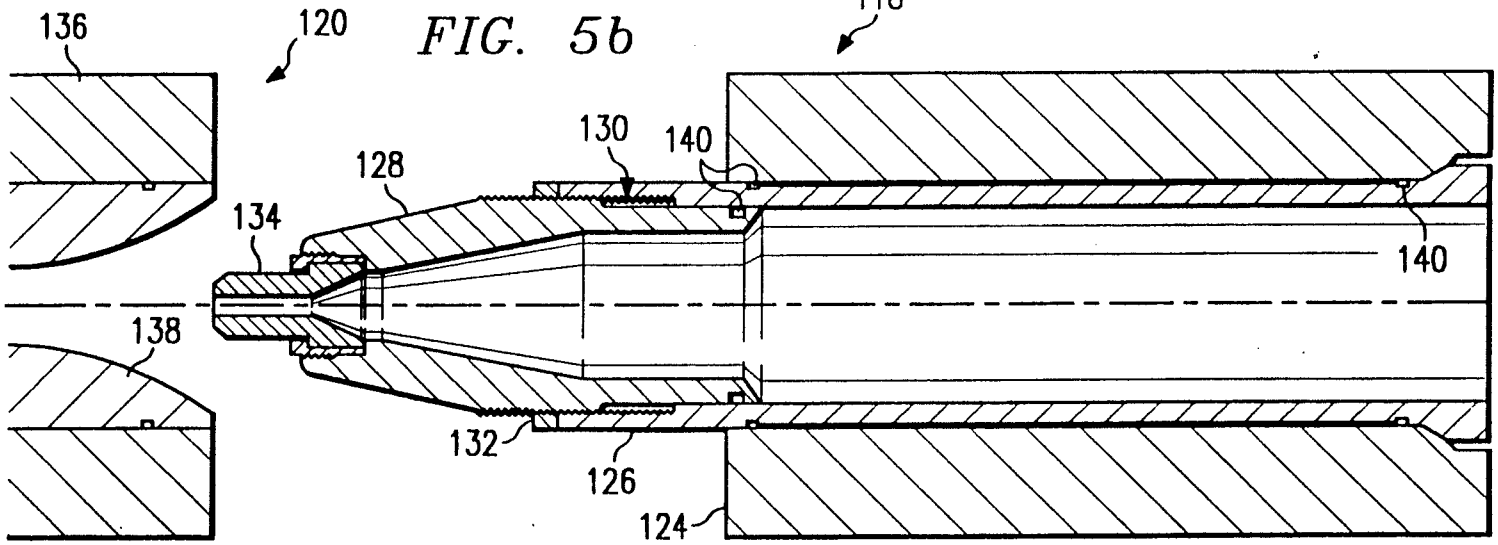

FIG. 5*b* is a detailed cross-sectional side view of the jet nozzle assembly 118. This view shows a more detailed view of the threads 130 between the nozzle housing 128 and the inner sleeve 126 along with exemplary dimensions for the nozzle assembly 118. Also shown are O-rings 140 for maintaining a seal between the assembly subcomponents.

While the present invention illustrated in connection with the hole cleaner which operates to remove cuttings while being pulled towards entry O (as shown in FIG. 1), the cuttings could also be removed as the hole cleaning device is pushed forward through the hole.

Further, while the embodiment shown in FIGS. 3–5 is designed for removing cuttings 102 after the hole is formed, the hole cleaning device 100 could be combined with a reamer or other hole opening device such that the formation of the hole and the removal of the cuttings occur simultaneously. A preferred embodiment of such a device is shown in FIG. 6.

FIG. 6 illustrates a perspective view of a reamer/hole cleaner 200 which simultaneously enlarges a hole and removes cuttings from the enlarged hole. The reamer/-hole cleaner 200 comprises a leading sub 202 having a threaded connecting member 204 for attaching to a leading drill pipe. A cutter mounting plate 206 is attached to the sub 202. First stage cutters 208 extend outwardly from the cutting mounting plate 206. In the preferred embodiment, there are three first stage cutters 208 spaced evenly about the circumference of the cutter mounting plate 206.

An inlet pipe 210 is formed through the sub 202 and continues through the reamer/hole cleaner body. A plurality of cleaning jets 212 are communication with the inlet pipe. Also coupled to the inlet pipe 210 are jet nozzles 214. The jet nozzles 214 are in communication with diffusers 216 formed through the mounting plate 206 and the body 218 of the reamer/hole cleaner 200.

A second stage mounting plate 220 is coupled to the body 218. The second stage mounting plate 220 is coupled to second stage cutters 222. Second stage cleaning jets are coupled to inlet pipe 210. Second stage jet nozzles 224 are coupled to inlet pipe 210 and are in communication with second stage diffusers 226. In the preferred embodiment, there are three jet nozzle 224/diffuser 226 assemblies interspersed about the circumference of the second stage mounting plate 220.

Stabilizers 228 are rotatably mounted between mounting plates 220 and 230. Each stabilizer comprises a roller portion 232 and a cutting portion 234 having teeth 236. Rear housing 237 forms a chamber 238. In the preferred embodiment, rear housing 237 has apertures to further remove cuttings from the hole.

The diffusers 216 and 226 feed into chamber 238 through transfer pipes 239. Within the chamber 238, a third stage jet nozzle is in communication with a third stage diffuser 242 disposed within the trailing sub 244. The trailing sub 244 has an outlet pipe 246 coupled to a connecting portion 248. Supports 250 are coupled between the body 218 and sub 244.

In operation, the cleaner/reamer is rotated through an initial bore hole, as is described in connection with FIG. 1. The first and second stage of cutters 208 and 222 enlarge the diameter of the bore hole to a desired diameter. Stabilizers 228 (positioned as shown in connection with FIG. 6*b*) maintain the reamer/hole cleaner 200 within the hole. The cutting portion 234 of the stabilizers 228 remove any remaining debris from the walls of the enlarged bore hole which would otherwise create undue friction with the rolling portion 232, thereby wear down the rolling portion 232 and reducing its stabilizing effect.

During the reaming operation, water or drilling fluid is forced through inlet pipe 210. The fluid is expelled at cleaning jets 212 which spray against the cutters 208 to remove any debris which has stuck to the cutters 208. Similarly, fluid is forced from the second stage cleaning jets 223 which clean cutters 222.

Additionally, fluid forced through inlet pipe 210 is expelled through first stage jet nozzles 214, second stage jet nozzles 224 and third stage jet nozzles 240. The combination of jet nozzles 214 and diffusers 216, jet nozzles 224 and diffusers 226, and jet nozzle 240 and diffuser 242, each create a jet pump. The first stage jet nozzles 214/diffusers 216 create a low-pressure area behind cutters 208, thereby creating a suction to remove cuttings created from first stage cutters 208. The cuttings removed at this stage are transported through diffuser 216 and associated pipes 239. The second stage jet nozzles 224 and diffusers 226 remove cuttings created from the reaming action of second stage cutters 222. These cuttings are transported through diffuser 226 and associated pipes 239 to chamber 238, along with the cuttings from the first stage jet pumps. The cuttings from both stages are removed via the jet pump comprising jet nozzle 240 and diffuser 242 along with cutting received through housing 237. These cuttings are removed via outlet pipe 246 to exit hole E, where the fluid and cuttings are processed by a solids control substation.

Another important aspect of the cutter/reamer 200 is the helical grooves 252 formed in the body 218. The grooves 252 further act to pump cuttings away from the cutters 208 and 222 to reduce wear on the cutters.

The present invention provides significant advantages over the prior art in that cuttings may be removed without additional working parts, thereby increasing the reliability of the hole cleaning device.

Figure 7:
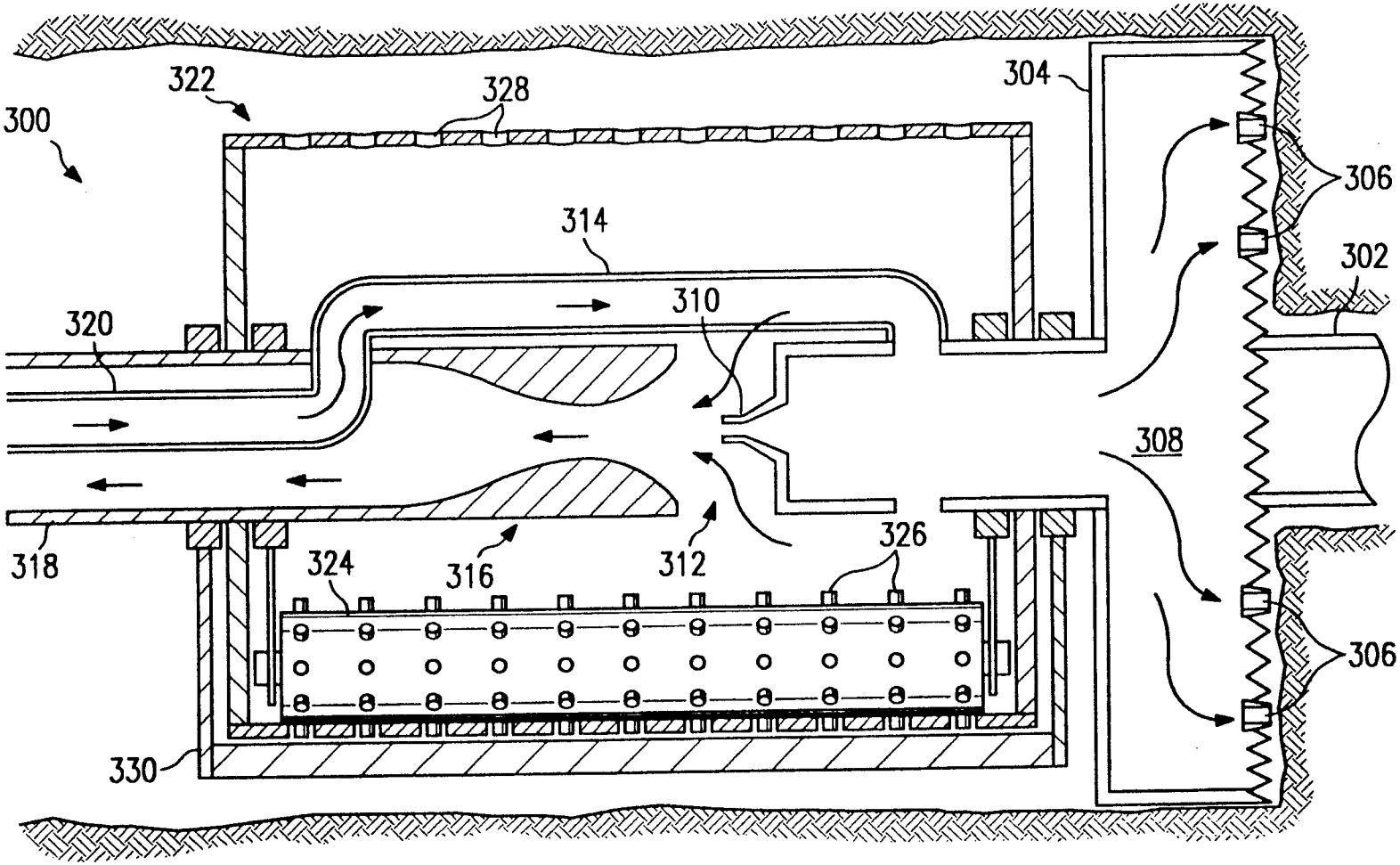
FIG. 7 illustrates an alternative embodiment of a hole cleaner having an aperture cleaning device.

FIG. 7 illustrates a cross-sectional side view of an alternative embodiment of a reamer/hole cleaner. The reamer/hole cleaner 300 comprises a leading drill pipe 302 coupled to a reamer 304 having nozzles 306 formed therethrough. A chamber 308 is formed within the reamer 304. The chamber 308 is in communication with jet nozzle 310 of jet pump 312 and bypass pipe 314. Diffuser 316 of jet pump 312 is coupled to a trailing outer pipe 318. Inner pipe 320 is disposed within trailing outer pipe 318 and is in communication with bypass pipe 314. Housing 322 surrounds jet pump 312 and bypass pipe 314. An aperture cleaning cylinder 324 having extrusions 326 is rotatably mounted within housing 322. Extrusions 326 mate with apertures 328 formed in housing 322. A scraper 330 is mounted exterior to housing 322.

In operation, fluid is pumped to the reamer/cleaner 300 through inner pipe 320. The bypass pipe 314 bypasses the jet pump 312 to force fluid through the jet nozzle 310. Further, fluid is forced into cavity 308 and out nozzles 306 to provide drilling fluid to the reamer 304. The reamer 304 is pulled and rotated by the leading drill pipe 302 which is connected to a drill rig. As the reamer 304 is rotated, cuttings are collected in the housing 322 and pumped via the jet pump 312 to the surface via trailing outer pipe 318. Scraper 330 removes cuttings from the exterior of housing 322 as the housing 322 rotates. After scraping, cleaning cylinder 324 rotates about the interior of housing 322 and pushes against any cuttings which have clogged apertures 328.

In an important aspect of this embodiment, the drilling fluid returns via trailing outer pipe 318 to a solids control system located at the source of the drilling fluid. Thus, the drilling fluid may be processed and returned to the reamer/hole cleaner 300 at a single site, in this case, exit hole E. This eliminates the cost of reclaiming the drilling fluid at the entry opening 0 and transporting it to the exit opening E for further use.

In an alternative embodiment, drilling fluid enters chamber 308 from both the inner pipe 320 and through the leading drill pipe 302, such that additional pressure may be provided.

Figure 6A:
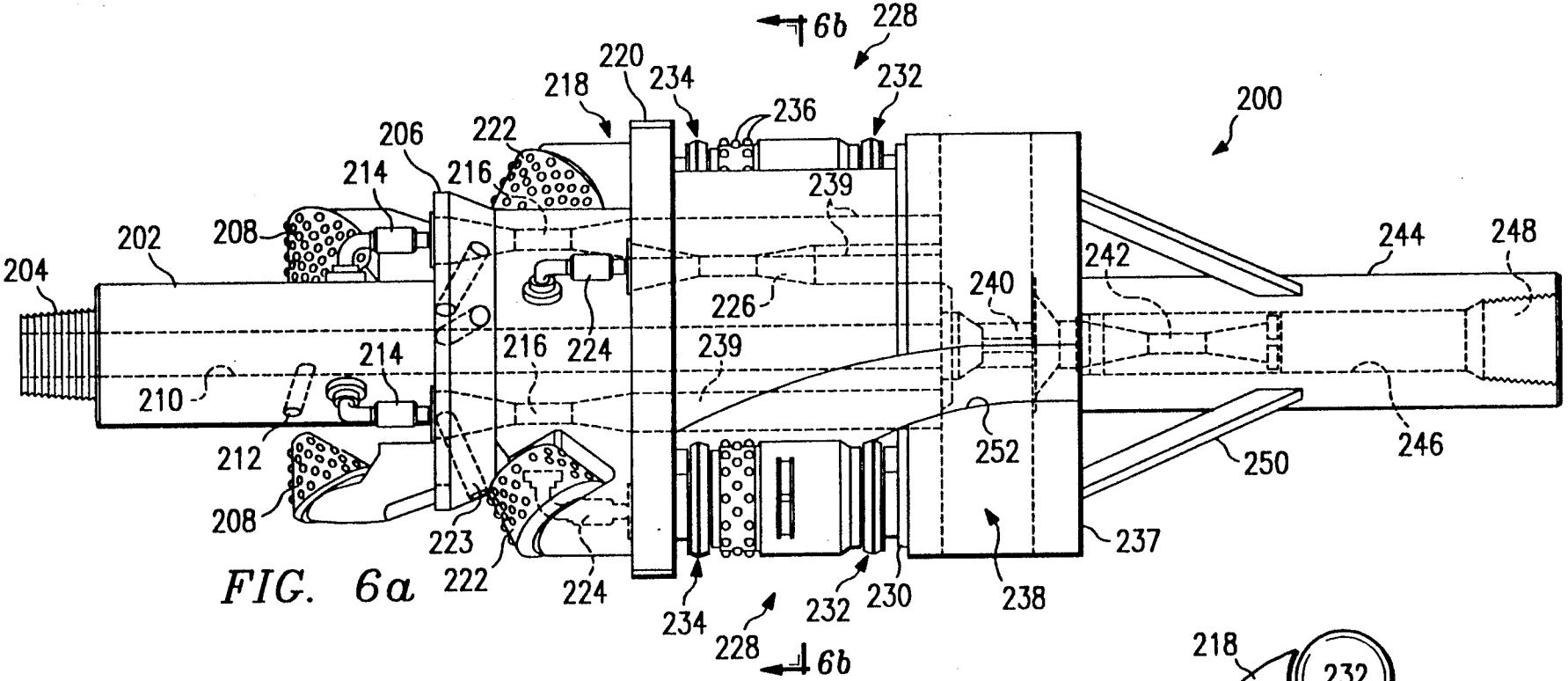
FIGS. 6*a* and 6*b* illustrate perspective and cross-sectional views of a reamer/hole cleaner combination.
Figure 6B:
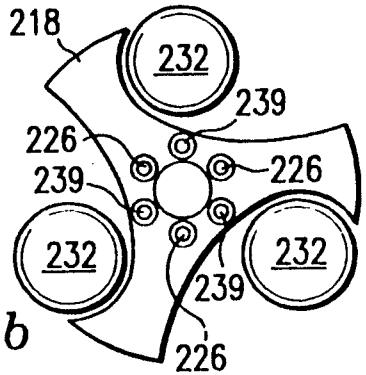

It should be noted, that the structure of inner pipe 320 and bypass pipe 314 could be added to the reamer/hole cleaner 200 of FIGS. 6*a–b* in order to provide that device with single-site processing of the drilling fluid.

Another important aspect of FIG. 7 is the apparatus for maintaining clear apertures in the housing 322. The scraper 330 knocks exterior cuttings from the housing. The cylinder 324 interacts with the apertures 328 to push any remaining cuttings out of the apertures 328. By maintaining clear apertures 328, a greater percentage of the cuttings may be removed from the hole. This structure may also be used with the reamer/hole cleaner 200 of FIGS. 6*a–b* to clean rear housing 237.

Although the present invention and its advantages have been described in detail, it should be understood that various changes, substitutions and alterations can be made herein without departing from the spirit and scope of the invention as defined by the appended claims.

What is claimed is:

1. Apparatus for removing cuttings from a bore hole having first and second openings, comprising:

a housing having a porous region to communicate cuttings from the bore hole to the interior of the housing;

a jet pump for creating a suction to draw cuttings from said bore hole into the housing;

an inlet pipe for communicating fluid to said jet pump from the first opening of said bore hole; and an outlet pipe for transporting the cuttings out of said housing to the second opening of said bore hole.

2. The apparatus of claim 1 wherein said jet pump comprises:

a nozzle having an inlet and an outlet, said outlet being in communication with porous region; and one or more inlet pipes in communication with said inlet for forcing a substance through said nozzle.

3. The apparatus of claim 2 wherein said jet pump further comprises a diffuser having an inlet and an outlet, the inlet of the diffuser in communication with the outlet of the nozzle and the outlet of the diffuser in communication with the outlet pipe.

4. The apparatus of claim 2 wherein said nozzle comprises a jet nozzle.

5. The apparatus of claim 4 wherein said nozzle include means for adjusting the length of said nozzle.

6. The apparatus of claim 2 wherein said substance comprises water.

7. The apparatus of claim 1 and further comprising a solid control system coupled to said outlet pipe.

8. The apparatus of claim 1 and further comprising a motor for rotating the housing.

9. The apparatus of claim 1 wherein said porous region comprises a grate.

10. The apparatus of claim 1 wherein said porous region comprises a plurality of holes formed through said housing.

11. A method for removing cuttings from a bore hole having first and second openings, comprising the steps of:

transporting a housing having a porous region within the bore hole;

transporting fluid from the first opening of the bore hole to the housing;

ejecting said fluid at a high speed through said housing to create a low-pressure area to pull cuttings from the bore hole through the porous region into the housing; and transporting the cuttings out of the housing to the second opening of the bore hole.

12. The method of claim 11 wherein the ejecting step comprises the step of forcing a substance through a nozzle.

13. The method of claim 12 wherein the ejecting step further comprises the step of directing the output of the nozzle to a diffuser member.

14. The method of claim 12 wherein the step of forcing a substance through a nozzle comprises the step of forcing a substance through a jet nozzle.

15. The method of claim 12 wherein the ejecting step comprises the step of forcing water through a nozzle.

16. The method of claim 11 and further comprising the step of processing the output of the outlet pipe.

17. The method of claim 11 wherein the step of transporting the housing comprises the step of rotating the housing in the bore hole.

18. The method of claim 17 and further comprising the step of simultaneously expanding the diameter of the bore hole.

* * * * *